US006058287A

United States Patent [19]

Haneda et al.

[11] Patent Number: 6,058,287

[45] Date of Patent: May 2, 2000

[54] IMAGE FORMING APPARATUS HAVING SHEET CONVEYANCE DEVICE

[75] Inventors: Satoshi Haneda; Kunio Shigeta; Yotaro Sato; Hisayoshi Nagase; Shuta Hamada, all of Hachioji, Japan

[73] Assignee: Konica Corporation, Japan

[21] Appl. No.: 08/923,804

[22] Filed: Sep. 4, 1997

[30] Foreign Application Priority Data

Sep. 12, 1996 [JP] Japan ..... 8-241846

[51] Int. Cl.[7] ..... G03G 15/00

[52] U.S. Cl. ..... 399/397; 399/400; 399/92

[58] Field of Search ..... 399/309, 322, 399/397, 400, 405, 316, 92

[56] References Cited

U.S. PATENT DOCUMENTS

| | | | |
|---|---|---|---|
| 4,377,229 | 3/1983 | Miyashita et al. | 198/494 |
| 4,525,057 | 6/1985 | Kaufmann et al. | 399/322 |
| 4,862,215 | 8/1989 | Nomura et al. | 399/400 |
| 4,876,576 | 10/1989 | Itaya et al. | 399/322 |
| 5,027,159 | 6/1991 | Oda et al. | 399/309 |
| 5,402,220 | 3/1995 | Tanaka et al. | 399/68 |
| 5,799,226 | 8/1998 | Shigeta et al. | 399/66 |

FOREIGN PATENT DOCUMENTS

| | | |
|---|---|---|
| 3-134693 | 6/1991 | Japan . |
| 6-118809 | 4/1994 | Japan . |
| 7-132659 | 5/1995 | Japan . |
| 7-251997 | 10/1995 | Japan . |

*Primary Examiner*—Robert Beatty

*Attorney, Agent, or Firm*—Jordan B. Bierman; Bierman, Muserlian and Lucas

[57] ABSTRACT

An image forming apparatus includes a first image carrier for carrying a toner image formed thereon; a second image carrier for carrying the toner image transferred from the first image carrier and for conveying a recording sheet; a first transfer device for transferring the toner image carried on the first image carrier onto the second image carrier or an obverse side of the recording sheet; a second transfer device for transferring the toner image carried on the second image carrier onto a reverse side of the recording sheet and a fixing device for fixing the toner image transferred on the recording sheet. The second image carrier is provided with a curved portion at an end on a side of the fixing device, at which the recording sheet conveyed by the second image carrier is bent toward the reverse side of the recording sheet so as to separate the recording sheet from the second image carrier. A conveyor is provided between the curved portion and the fixing device, having rotatable spurred wheels each equipped with a plurality of protrusions on a circumferential surface thereof for conveying the separated recording sheet to the fixing device, wherein the spurred wheels contact to guide the obverse or reverse side of the recording sheet so that a moving direction of the recording sheet is changed toward a side which is opposite to the side where the spurred wheels contact the recording sheet.

9 Claims, 7 Drawing Sheets

IMAGE FORMING APPARATUS HAVING SHEET CONVEYANCE DEVICE

BACKGROUND OF THE INVENTION

The present invention relates to an image forming apparatus of an electrophotographic type such as a copying machine, a printer and a facsimile machine wherein a charging means, an image writing means and a developing means are arranged around an image carrier to transfer toner images formed on the image carrier onto a recording sheet and to fix them thereon, and in particular, to an image forming apparatus capable of forming images on both sides of a recording sheet.

In two-sided image forming, there has so far been employed a method wherein an image formed on one side of an image carrier is transferred and fixed on a recording sheet which is then kept temporarily in an intermediate tray, and the recording sheet is fed out of the intermediate tray in synchronization with an image formed next on the image carrier so that the image is transferred and fixed on the other side of the recording sheet.

In the two-sided image forming apparatus of this type, conveyance operations for a recording sheet such as conveyance thereof to an intermediate tray and conveying a recording sheet through a fixing unit two times are conducted as stated above. Therefore, reliability for conveyance of a recording sheet is low, resulting in causes for jamming and creases on the recording sheet.

For the situation mentioned above, TOKKOSHO Nos. 49-37538 and 54-28740 and TOKKAIHEI Nos. 1-44457 and 4-214576 are suggesting an image forming apparatus and an image forming method wherein a first image carrying means and a second image carrying means are used so that toner images are formed on both sides of a recording sheet and then are fixed at the same time.

Further, the inventors of the invention are studying an image forming apparatus and an image forming method wherein a plurality of toner image forming means each being composed of a charging means, an image writing means and a developing means are arranged around a photoreceptor drum (first image carrying means), and color toner images formed and superposed on the photoreceptor drum are collectively transferred onto a toner image receiving body (second image carrying means) temporarily, and then, superposed color toner images are formed on the photoreceptor drum next, thus, both superposed color toner images are transferred respectively on both sides of a recording sheet supplied in synchronization with the toner images on the photoreceptor drum and the toner images on the toner image receiving body, with the toner images on the photoreceptor drum representing an image for obverse side and the toner images on the toner image receiving body representing an image for reverse side, after that, the recording sheet is separated from the toner image receiving body and the toner images on the recording sheet are fixed, so that two-sided color images are formed.

In the image forming apparatus and the image forming method, the toner image receiving body (second image carrying means) and the fixing unit are arranged to be close to each other so that the recording sheet separated from the toner image receiving body may be fed into the fixing unit directly, because the recording sheet having on its both sides unfixed toner images needs to be conveyed to the fixing unit (fixing means). However, when the toner image receiving body is arranged to be close to the fixing unit, there are caused problems that the toner image receiving body is deformed by heat coming from the fixing unit, toner images transferred onto the toner image receiving body are slightly fused to become difficult to be transferred, or toner sticks to the toner image receiving body. In addition, there are caused problems that toner images on the recording sheet are disturbed, or creases are caused on the recording sheet when the recording sheet is held in the fixing unit to be sandwiched therein, resulting in inability of forming excellent two-sided images, because conveyance of the recording sheet separated from the toner image receiving body is not conveyed uniformly but is conveyed ruggedly depending on the type of the recording sheet.

SUMMARY OF THE INVENTION

An object of the invention is to solve the problems mentioned above and to provide an image forming apparatus which is free from the problems that a second image carrying means is deformed by heat coming from a fixing means, toner images on the second image carrying means are slightly fused to become difficult to be transferred, and toner sticks on the second image carrying means, and in which the recording sheet separated from the second image carrying means can be conveyed stably to the fixing unit while the toner images thereon are not disturbed, regardless of the type of the recording sheet, and no creases are caused when the recording sheet is held in the fixing unit to be sandwiched therein, thus, excellent two-sided images can be formed.

An image forming apparatus having therein:

- a first image carrying means carrying toner images formed by a toner image forming means;
- a second image carrying means onto which the toner images carried by the first image carrying means are transferred and carries on its obverse surface the transferred toner images and conveys the recording sheet;
- a first transfer means which transfers the toner images carried by the first image carrying means onto the second image carrying means and onto the obverse side of the recording sheet;
- a second transfer means which transfers the toner images carried by the second image carrying means onto the reverse side of the recording sheet; and
- a fixing means which fixes the toner images transferred onto the recording sheet, wherein a curved portion is provided on the end portion of the second image carrying means on the fixing unit side so that the recording sheet is separated at the curved portion,

- a conveyance section having therein spurred wheels each being rotatable and has on its circumferential surface a plurality of protrusions are provided between the curved portion and the fixing means, so that the recording sheet may be fed into the fixing means by the conveyance section,
- the recording sheet conveyed by the second image carrying means is separated from the second image carrying means while the recording sheet is bent toward its reverse side along the curved portion, and
- the recording sheet separated from the second image carrying means is conveyed to the fixing means, while the reverse side or the obverse side of the recording sheet is being guided by the spurred wheels of the conveyance section and the moving direction of the recording sheet is being changed by the spurred wheels toward the side which is not in contact with the spurred wheels to be guided.

DETAILED DESCRIPTION OF THE PREFERRED EMBODIMENT

The structure of the invention will be explained as follows. Incidentally, in the explanation of the following structure, the surface of a recording sheet facing the first image carrying means in the transfer area is called an obverse side, while the surface on the other side of recording sheet, namely the surface of the recording sheet facing the second image carrying means is called a reverse side, and an image to be transferred onto the obverse side of the recording sheet is called an image for obverse side, and an image to be transferred onto the reverse side of the recording sheet is called an image for reverse side.

Figure 1:
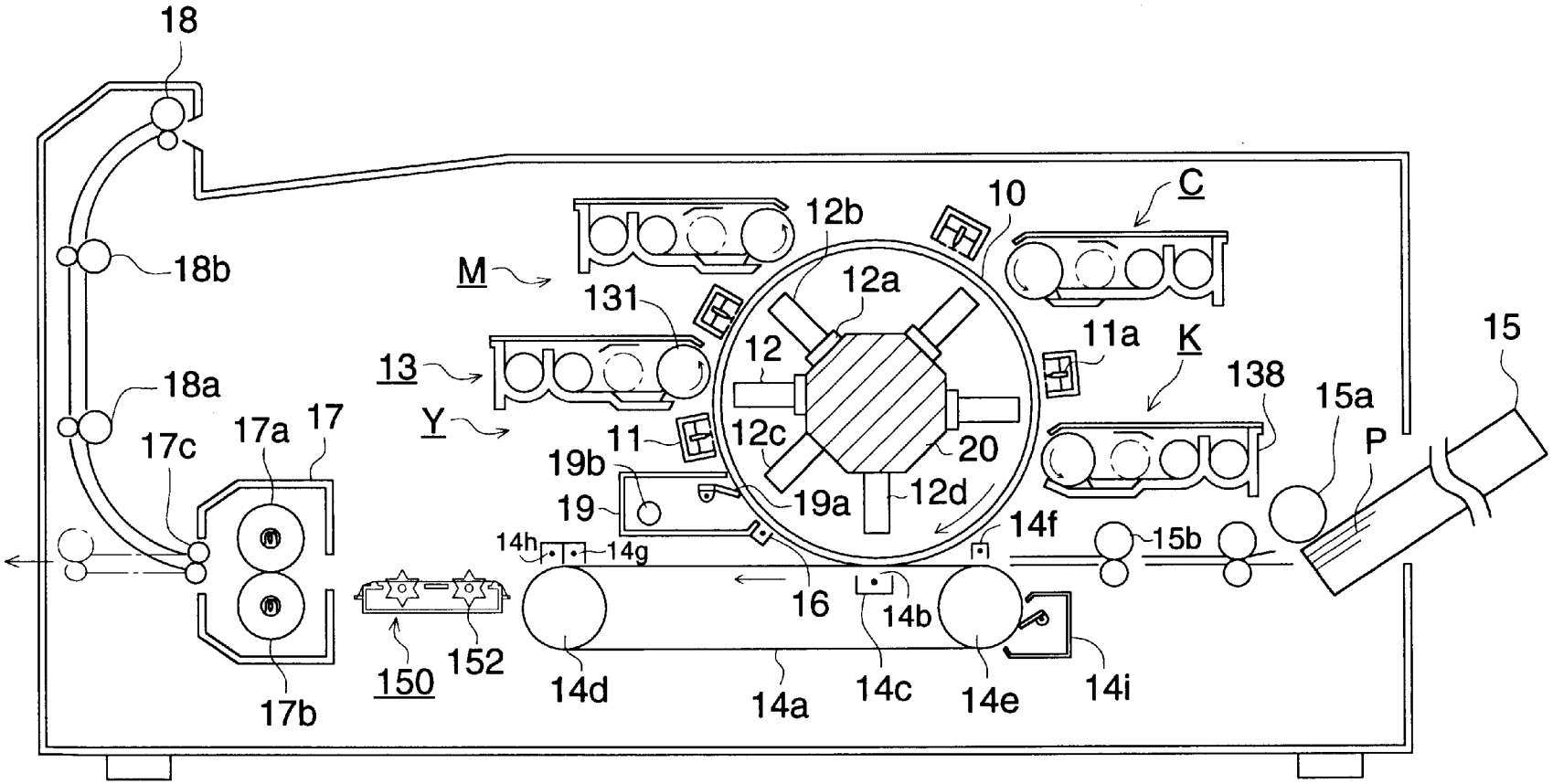
FIG. 1 is a sectional view of the structure of a color image forming apparatus showing an example of the image forming apparatus.
Figure 2:
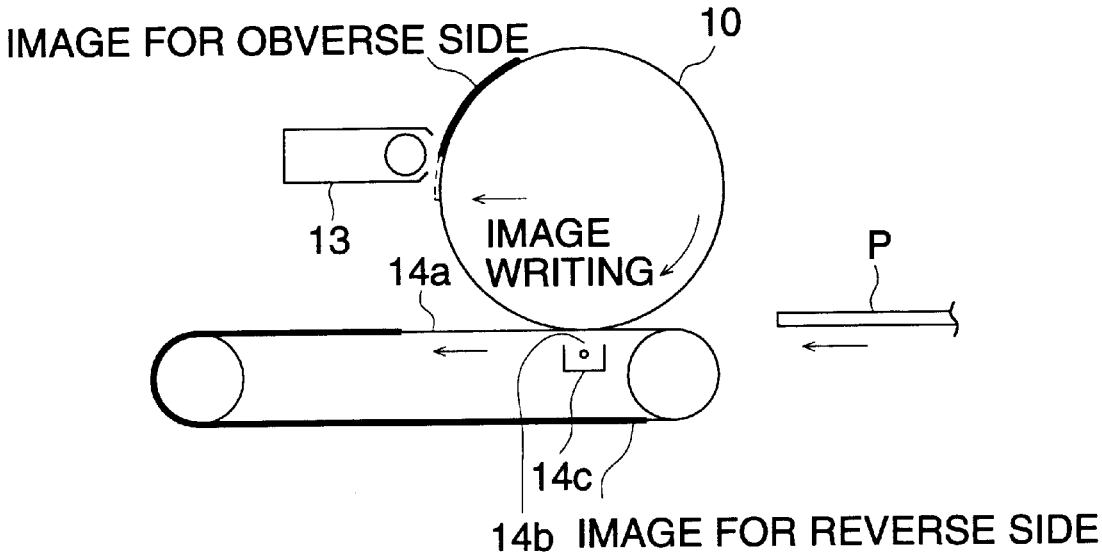
FIG. 2 is a diagram showing how two-sided toner images related to the image forming apparatus in FIG. 1 are formed.
Figure 3:
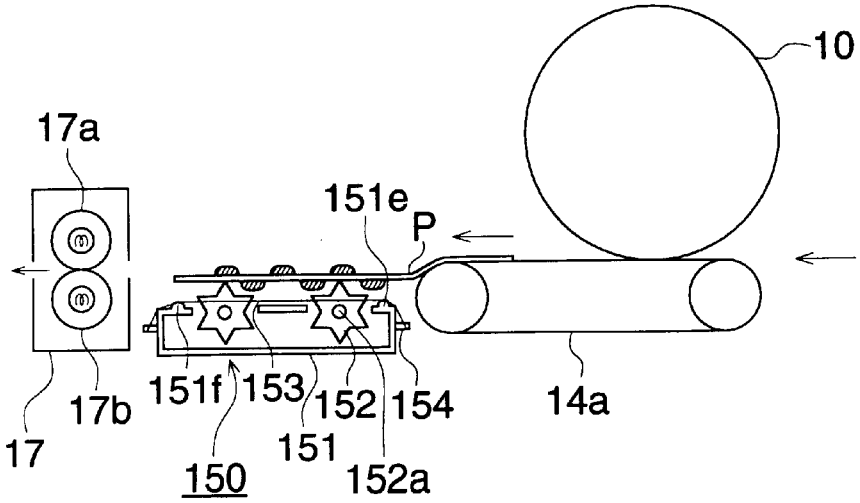
FIG. 3 is a diagram showing a conveyance section.
Figure 4:
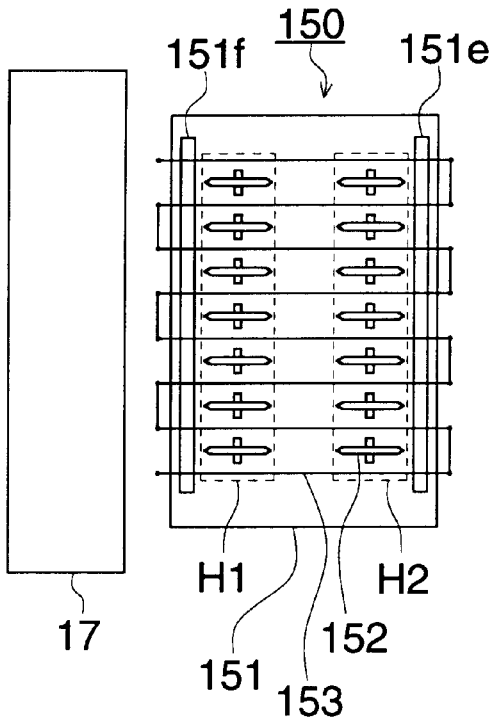
FIG. 4 is a top view of the conveyance section shown in FIG. 3.
Figure 5:
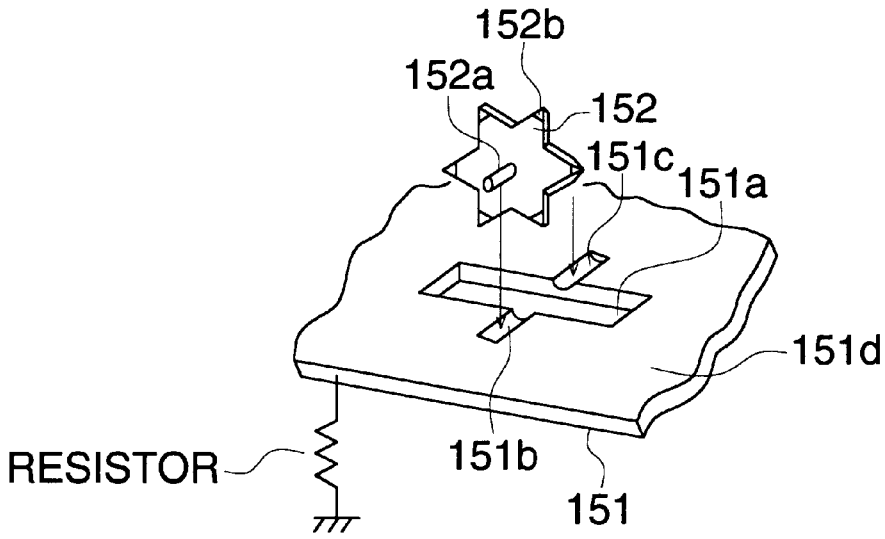
FIG. 5 is a perspective view of a spurred wheel.

An image forming process and each structure of an example of an image forming apparatus relating to the invention will be explained as follows, referring to FIGS. 1–5. FIG. 1 is a sectional view of the structure of a color image forming apparatus showing an example of the image forming apparatus of the invention, FIG. 2 is a diagram showing how two-sided toner images related to the image forming apparatus in FIG. 1 are formed, FIG. 3 is a diagram showing a conveyance section, FIG. 4 is a top view of the conveyance section shown in FIG. 3, and FIG. 5 is a perspective view of a spurred wheel.

In FIG. 1, the numeral 10 represents a photoreceptor drum which is a first image carrying means, 11 represents a scorotron charging unit which is a charging means for each color, 12 represents an exposure optical system which is an image writing means for each color, 13 represents a developing unit which is a developing means for each color, 14*a* is a toner image receiving body which is a second image carrying means, 14*c* represents a primary transfer unit which is a first transfer means, 14*f* represents a sheet charging unit which is a recording sheet transfer means, 14*g* represents a secondary transfer unit which is a second transfer means, 14*h* represents a sheet separation AC neutralizing unit which is a recording sheet separation means, 150 represents a conveyance section having spurred wheels 152, and 17 represents a fixing unit which is a fixing means.

Photoreceptor drum 10 which is a first image carrying means is one wherein a photosensitive layer such as a transparent conductive layer, an a-Si (amorphous silicon) layer or an organic photoconductor layer (OPC) is formed on an outer circumferential surface of a cylindrical base formed, for example, by a transparent member such as an optical glass or a transparent acrylic resin, and it is rotated in the clockwise direction shown with an arrow in FIG. 1 under the condition that its conductive layer is grounded.

Scorotron charging unit 11 which is a charging means for each color, exposure optical system 12 which is an image writing means for each color, and developing unit 13 which is a developing means for each color are combined to be one set, and four sets of them are provided as image forming processes for yellow (Y), magenta (M), cyan (C) and black (K), and they are arranged in the order of Y, M, C and K for the rotation direction of the photoreceptor drum 10 shown with an arrow in FIG. 1.

Scorotron charging unit 11 which is a charging means for each color has therein a control grid kept at a prescribed voltage and discharge electrode 11*a* composed, for example, of saw-toothed electrodes, and it is mounted to face the photosensitive layer of the photoreceptor drum 10, so that it conducts charging operations (negative charging in the present example) through corona discharging in the same polarity as in toner and gives uniform voltage to the photoreceptor drum 10. As discharging electrode 11*a*, it is possible to use a wire electrode or an acicular electrode, in addition to the foregoing.

Exposure optical system 12 which is an image writing means for each color is arranged inside photoreceptor drum 10 in a way that the position of its exposure is located at the downstream side for the scorotron charging unit 11 for each color in the rotating direction of the photoreceptor drum 10. Each exposure optical system 12 is a unit for exposure composed of line-shaped exposure element 12*a* wherein there are arranged, in a form of an array, plural LEDs (light-emitting diodes) representing light-emitting elements for imagewise exposure light arranged in the primary scanning direction to be in parallel with an axis of the photoreceptor drum 10, light-converging photo-transmitter (trade name: SELFOC lens array) serving as a full-scale imaging element 12*b*, and an unillustrated lens holder, and it is mounted on holding member 20. On the holding member 20, there are mounted unit for uniform exposure 12*c* and transfer-overlapping exposure unit 12*d* in addition to the exposure optical system for each color 12, and they are integrally housed inside the transparent base of the photoreceptor drum 10. The exposure optical system 12 for each color conducts imagewise exposure on a photosensitive layer of the photoreceptor drum 10 from the reverse side of the photosensitive layer, in accordance with image data for each color which are read by a separate image reading unit and stored in a memory, so that an electrostatic latent image may be formed on the photoreceptor drum 10. As the exposure element 12*a*, is possible to use, in addition to the foregoing, those wherein plural light-emitting elements such as FL (phosphor luminescence), EL (electro-luminescence), or PL (plasma discharge luminescence) are arranged in a form of an array. Though only exposure element 12*a* such as LED is enough for the unit for uniform exposure 12*c* and the transfer-overlapping exposure unit 12*d*, it is more preferable to use exposure unit 12 for imagewise exposure because it is possible to neutralize the photosensitive layer by exposing a narrow area without diffusing exposure light. Incidentally, with regard to a wavelength of luminescence of a light-emitting element for imagewise exposure light, the wavelength in a range of 780–900 nm which is highly transmissive for Y, M and C toners is usually used, but it is also possible to use the shorter wavelength in a range of 400–780 nm which is not highly transmissive for color toners, because imagewise exposure is conducted from the reverse side in the present example.

Developing unit 13 representing a developing means for each color has therein developing sleeve 131 which is made of cylindrical and non-magnetic stainless steel or aluminum material having a thickness of 0.5–1 mm and rotates in the same direction as that of the photoreceptor drum 10 while keeping a prescribed distance from the circumferential surface of the photoreceptor drum 10, and developing casing 138, and it houses therein single-component or two-component developing agent of yellow (Y), magenta (M), cyan (C) and black (K). Each developing unit 13 is kept, by an unillustrated stopper roller, to be away from the photoreceptor drum 10 by a prescribed distance, for example, by 100–500 $\mu$m on a non-contact basis, and it conducts non-contact reversal development to form a toner image on the photoreceptor drum 10 when developing bias voltage wherein DC voltage and AC voltage are superimposed is impressed on the developing sleeve 131.

Toner image receiving body 14*a* representing a second image carrying means is an endless belt having volume resistivity of $10^8$–$10^{15}$ Ω·cm, and it is, for example, a two-layer seamless belt wherein fluorine coating with a thickness of 5–50 $\mu$m is provided as a toner filming prevention layer on the outer surface of a semi-conductive rubber belt base having a thickness of 0.5–2.0 mm in which conductive materials are dispersed in silicone rubber or urethane rubber. As a belt base, it is also possible to use, in addition to the foregoing, a semi-conductive film having a thickness of 0.1–1.0 mm wherein conductive materials are dispersed in engineering plastic such as denatured polyimide, thermosetting polyimide, ethylenetetrafluoroethylene copolymer, polyvinylidenefluoride, or nylon alloy. Toner image receiving body 14*a* is spread over driving roller 14*d* and driven roller 14*e*, and it is rotated counterclockwise as shown with an arrow in FIG. 1.

Primary transfer unit 14*c* representing a first transfer means is provided to face the photoreceptor drum 10 with the toner image receiving body 14*a* serving as an in-between, so that it may form a transfer area 14*b* between the toner image receiving body 14*a* and the photoreceptor drum 10. When DC voltage whose polarity is opposite to that of toner (positive polarity in the present example) is impressed on the primary transfer unit 14*c*, and transfer electric field is formed on the transfer area 14*b*, the toner image on the photoreceptor drum 10 is transferred onto the toner image receiving body 14*a* or onto the obverse side of the recording sheet P representing a transfer material.

The secondary transfer unit 14*g* representing a second transfer means is provided to face conductive driving roller 14*d* which is grounded, with the toner image receiving body 14*a* serving as an in-between, and when DC voltage whose polarity is opposite to that of toner (positive polarity in the present example) is impressed on the secondary transfer unit 14*g*, the toner image on the toner image receiving body 14*a* is transferred onto the reverse side of the recording sheet P.

Sheet charging unit 14*f* representing a recording sheet charging means is provided to face driven roller 14*e* which is grounded, with the toner image receiving body 14*a* serving as an in-between, and it charges recording sheet P which is then attracted to the toner image receiving body 14*a*.

Sheet separation AC neutralizing unit 14*h* representing a recording sheet separation means is provided at the downstream side for the second transfer unit 14*g* on the end portion of the toner image receiving body 14*a* on the fixing unit 17 side to face the grounded conductive driving roller 14*d*, with the toner image receiving body 14*a* serving as an in-between. When the sheet separation AC neutralizing unit 14*h* is impressed with AC voltage superimposed with DC voltage having the polarity which is the same as or opposite to that of toner when necessary, it neutralizes recording sheet P conveyed by the toner image receiving body 14*a*, and separates it from the toner image receiving body 14*a*. Incidentally, when the recording sheet P is separated from the toner image receiving body 14*a*, it is preferable that the driving roller 14*d* that is in contact with the toner image receiving body 14*a* at its end portion on the fixing unit 17 side has the radius of curvature which is not more than 20 mm, and the radius of curvature of not more than 10 mm is more preferable. In particular, when the radius of curvature of the driving roller 14*d* is not more than 10 mm, it is also possible to omit the sheet separation AC neutralizing unit 14*h* which is a recording sheet separating means, because recording sheet P is separated by the curvature of the end portion of the toner image receiving body 14*a* on the fixing unit 17 side.

Conveyance section 150 has spurred wheels 152 each being rotatable and has on its circumferential surface a plurality of protrusions, and is provided between the toner image receiving body 14*a* and fixing unit 17. By providing the conveyance section 150 between the toner image receiving body 14*a* and fixing unit 17, it is possible to prevent that the toner image receiving body 14*a* is deformed by heat generated by the fixing unit 17, toner images carried by the toner image receiving body 14*a* are slightly fused and become difficult to be transferred, and toner sticks on the toner image receiving body 14*a*. As stated later, the conveyance section 150 conveys recording sheet P which has been separated from the toner image receiving body 14*a*, and has on its both sides toner images to the fixing unit 17 while guiding the reverse side or the obverse side of the recording sheet P by protrusions of the spurred wheels 152 and preventing disturbance of toner images.

Fixing unit 17 representing a fixing means is composed of two roller-shaped fixing members represented respectively by fixing roller 17*a* having therein a heater and by pressure roller 17*b*, and toner images on recording sheet P are fixed by heat and pressure both applied between the fixing roller 17*a* and the pressure roller 17*b*.

Next, image forming process will be explained below.

When image recording is started, an unillustrated photoreceptor driving motor is started, and it rotates photoreceptor drum 10 in the clockwise direction shown with an arrow in FIG. 1. Concurrently with this, scorotron charging unit 11 for yellow (Y) starts its charging operation to give voltage to the photoreceptor drum 10.

Images obtained as original images by an image reading apparatus which is independent from the present apparatus through its reading or images compiled by a computer are stored temporarily in a memory as image data for each color of Y, M, C and K.

After being given voltage, the photoreceptor drum 10 is subjected to image writing conducted by exposure optical system 12 for Y in accordance with electric signals corresponding to the image data for the first color signal, namely for Y, and an electrostatic latent image corresponding to the image for Y in the original image is formed on the surface of the photoreceptor drum 10.

The latent image mentioned above is subjected to reversal development conducted by developing unit 13 for Y on a non-contact basis, and thereby a toner image for yellow (Y) is formed on the photoreceptor drum 10.

Then, voltage is given on the toner image for Y on the photoreceptor drum 10 by charging operation of scorotron charging unit 11 for magenta (M), and the photoreceptor drum 10 is subjected to image writing conducted by exposure optical system 12 for M in accordance with electric signals corresponding to the image data for the second color signal, namely for M, thus, the toner image for magenta (M) is formed to be superposed on the toner image for yellow (Y) mentioned above through non-contact reversal development conducted by developing unit 13 for M.

In the same process as in the foregoing, a toner image for cyan (C) corresponding to the third color is formed to be superposed by scorotron charging unit 11 for cyan (C), exposure optical system 12 for C and developing unit 13 for C, and on that toner image, a toner image for black (K) corresponding to the fourth color is formed to be superposed in succession by scorotron charging unit 11 for black (K), exposure optical system 12 for K and developing unit 13 for K. Thus, the superposed color toner images of four colors of yellow (Y), magenta (M), cyan (C) and black (K) are formed on the circumferential surface of the photoreceptor drum 10 within its one turn (toner image forming means).

Image writing conducted by each of exposure optical systems 12 for Y, M, C and K on the photosensitive layer of the photoreceptor drum 10 is carried out through a transparent base from the inside of the drum. Therefore, image writing for the second, third and fourth color signals can be conducted without being affected by the toner image formed in the preceding step, and electrostatic latent images for them which are the same as the image corresponding to the first color signal can be formed accordingly.

Superposed color toner images formed to be an image for reverse side by the aforesaid image forming process on the photoreceptor drum 10 which is a first image carrying means are collectively transferred, at transfer area 14*b*, onto toner image receiving body 14*a* representing a second image carrying means by primary transfer unit 14*c* representing a first transfer means. In this case, it is also possible to arrange so that uniform exposure may be carried out for excellent transfer by transfer-overlapping exposure unit 12*d* provided inside the photoreceptor drum 10.

Toner remaining on the circumferential surface of the photoreceptor drum 10 after transfer goes to cleaning unit 19 serving as a photoreceptor drum cleaning means, after being subjected to neutralizing performed by photoreceptor drum AC neutralizing unit 16, then is removed by cleaning blade 19*a* which is made of rubber material and is in contact with the photoreceptor drum 10, and is collected in an unillustrated waste toner container by screw 19*b*. The circumferential surface of the photoreceptor drum 10 is subjected to exposure conducted by pre-charging uniform exposure unit 12*c* employing, for example, light-emitting diodes, so that hysteresis of the photoreceptor drum 10 caused by the preceding image forming may be eliminated.

After the superposed color toner images which are to be images for reverse side are formed on the toner image receiving body 14*a* in the aforesaid way, the superposed color toner images which are to be images for obverse side are formed successively on the photoreceptor drum 10 in the same way as in the aforesaid color image forming process. In this case, image data are changed so that images for obverse side formed on the photoreceptor drum 10 may represent a reflected image for the image for reverse side formed on the photoreceptor drum 10.

Along with formation of an image for obverse side on the photoreceptor drum 10, recording sheet P is fed out of sheet-feeding cassette 15 which is a recording sheet storing means by feed-out roller 15*a*, then is conveyed to timing roller 15*b* representing a recording sheet feeding means, and is conveyed to transfer area 14*b* (FIG. 2) by the timing roller 15*b*, with color toner images for images for obverse side carried on the photoreceptor drum 10 and color toner images for images for reverse side carried on the toner image receiving body 14*a* both of which are synchronized each other. In this case, recording sheet P is sheet-charged to the same polarity as that of toner by sheet-charging unit 14*f* which is provided on the obverse side of recording sheet P to be fed and is impressed with DC voltage with the same polarity as that of toner (negative polarity in the present example), and the recording sheet P is attracted to the toner image receiving body 14*a* to be fed to transfer area 14*b*. By sheet-charging the recording sheet P to the same polarity as that of toner, the recording sheet P is prevented from attracting toner images on the toner image receiving body 14*a* or toner images on the photoreceptor drum 10, whereby disturbance of toner images is prevented. Incidentally, voltage is impressed on sheet-charging unit 14*f* only when the recording sheet P is being conveyed, and impression of voltage on the sheet-charging unit 14*f* is cut simultaneously with the passage of the recording sheet P.

In the transfer area 14*b*, images for obverse side on the photoreceptor drum 10 are collectively transferred onto the obverse side of the recording sheet P by primary transfer unit 14*c* serving as a first transfer means which is to be impressed with voltage having polarity opposite to that of toner (positive polarity in the present example). In this case, images for reverse side on the toner image receiving body 14*a* are not transferred onto the recording sheet P and stay on the toner image receiving body 14*a*. In the case of transfer by means of transfer unit 14*c*, it is also possible to arrange so that uniform exposure may be carried by transfer-overlapping exposure unit 12*d* which employs light-emitting diode, for example, and is provided inside the photoreceptor drum 10 to face the transfer area 14*b*, so that excellent transfer can be carried out.

The recording sheet P having on its obverse side the transferred color toner images is conveyed to secondary transfer unit 14*g* serving as a second transfer means on which voltage having polarity opposite to that of toner (positive polarity in the present example) is impressed, where the images for reverse side formed on the circumferential surface of the toner image receiving body 14*a* are collectively transferred onto the reverse side of the recording sheet P by secondary transfer unit 14*g*.

The recording sheet P having on its both sides color toner images formed is separated from the toner image receiving body 14*a* through the curvature of driving roller 14*d* that drives the toner image receiving body 14*a* and through the neutralizing operation conducted by sheet separation AC neutralizing unit 14*h* representing a recording sheet separating means provided at the end portion of the toner image receiving body 14*a*, and is passed through conveyance section 150 in which spurred wheels 152 stated later are provided, and conveyed to fixing unit 17 which is a fixing means where toner images on the recording sheet P are fixed when heat and pressure are applied on the recording sheet P when it is between fixing roller 17*a* and pressure roller 17*b*. The recording sheet P which has been subjected to two-sided image recording is reversed upside down and conveyed by fixing ejection roller 17*c*, conveyance rollers 18*a* and 18*b* and ejection roller 18, and is ejected on a tray located on the top of an apparatus with its images for obverse side facing downward. As shown with one-dot chain lines in FIG. 1, it is also possible to provide an unillustrated switching member at the rear portion of the fixing ejection roller 17*c* located at an outlet of the fixing unit 17 so that the recording sheet P can be ejected, with its images for obverse side facing upward, to a tray outside the apparatus.

Toner remaining on the surface of the toner image receiving body 14*a* after transfer is removed by toner image receiving body cleaning unit 14*i* provided to face driven roller 14*e* with the toner image receiving body 14*a* serving as an in-between.

Toner remaining on the photoreceptor drum 10 after transfer is neutralized by photoreceptor drum AC neutralizing unit 16, and then is removed by cleaning unit 19, and hysteresis of the photoreceptor drum 10 caused by the preceding image forming is eliminated by pre-charging uniform exposure unit 12*e* to enter the following image forming cycle.

When the method mentioned above is used, superposed color toner images can be collectively transferred, and therefore, color-doubling of color images on the toner image receiving body 14*a*, and toner scattering and scrubbing are hardly caused, thus, excellent two-sided color image forming with less image deterioration can be carried out.

Next, a conveyance section having therein spurred wheels will be explained as follows, referring to FIGS. 3–5.

Conveyance section 150 having therein spurred wheels 152 is provided between the tone image receiving body 14*a* and fixing unit 17, and spurred wheels 152 are provided respectively as group H1 and group H2 each being composed of plural spurred wheels arranged in parallel in the direction perpendicular to the conveyance direction for recording sheet P, namely in the longitudinal direction of fixing unit 17. The conveyance section 150 conveys recording sheet P which has been separated from the toner image receiving body 14*a* and has on its both sides toner images to the fixing unit 17 while guiding the reverse side (bottom side) of the recording sheet with spurred wheels 152.

The conveyance section 150 is composed of casing 151, plural spurred wheels 152 attached to the casing 151 and wire 153 spread over the casing 151. On the top surface 151*d* of the casing 151, there is formed square hole 151*a* which is provided with grooves 151*b* and 151*c* arranged in the direction perpendicular to the longitudinal direction of the square hole. Shaft 152*a* provided at the center of the spurred wheel 152 is engaged with the grooves 151*b* and 151*c*, whereby the spurred wheel 152 is rotatably mounted on the casing 151. On the side of the casing 151, there is provided pin 154 which is used when the wire 153 is spread over the casing 151. In this case, owing to protrusions 151*e* and 151*f* provided on the top surface of the casing 151, the wire 153 serving as a guide member is stretched to be slightly higher than the shaft 152*a* which is the center of rotation of the spurred wheel 152.

The spurred wheel 152 is one having preferably a thickness of 0.05–0.5 mm and an outside diameter of 5–25 mm and having on its circumferential surface a plurality of protrusions. For example, it is composed of a metal sheet such as a stainless steel sheet or an aluminum sheet having a thickness of 0.2 mm subjected to etching processing to be a sheet-shaped member that is hexagonal and has an outside diameter of 10 mm and is provided on its edges with sharp protrusions 152*b*. The spurred wheel 152 is grounded through a resistor having high resistance of $10^{10}$–$10^{14}$ Ω to prevent charge accumulation of the spurred wheel 152 itself and to prevent that charged toner is stuck to the spurred wheel 152 by image force, thus the recording sheet P can be conveyed without disturbance of toner images.

When the recording sheet P on both sides of which the toner images are transferred is conveyed to the conveyance section 150, the leading edge of the recording sheet P is lifted by the wire 153 stretched in the upper part by the shaft 152*a* of rotation center of the spurred wheel 152, then, the spurred wheel 152 is driven to rotate and whereby the recording sheet P is conveyed to the fixing unit 17, under the condition that the protrusion 152*b* of the spurred wheel 152 is in contact with or is pierced in the recording sheet P. Since the toner image on the reverse side (lower side) of the recording sheet P is guided by the protrusion 152*b* whose tip is sharp to be fed out to the fixing unit 17, the toner image is not scrubbed and thereby, it is not disturbed.

In the example stated above, the conveyance section 150 having spurred wheels 152 is provided over the reverse side of recording sheet P conveyed from the toner image receiving body 14*a* to the fixing unit 17 so that the reverse side of the recording sheet P may be guided. However, it is also possible to provide the conveyance section 150 having spurred wheels 152 over the obverse side of the recording sheet P to guide the obverse side of the recording sheet P, or to provide the conveyance section 150 over both of the reverse side and the obverse side of the recording sheet P to be able to guide the reverse side or the obverse side depending on how the recording sheet P is conveyed.

Figure 6:
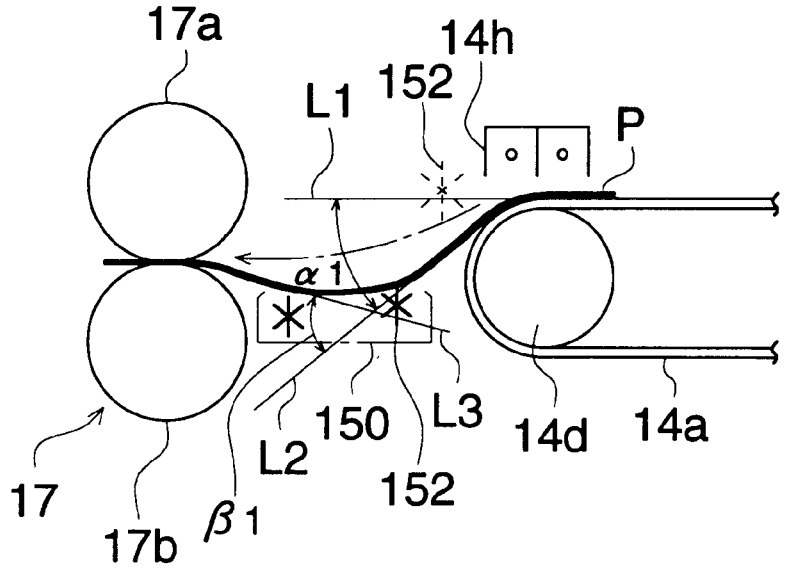
FIG. 6 is a diagram showing an example of the conveyance section.
Figure 7:
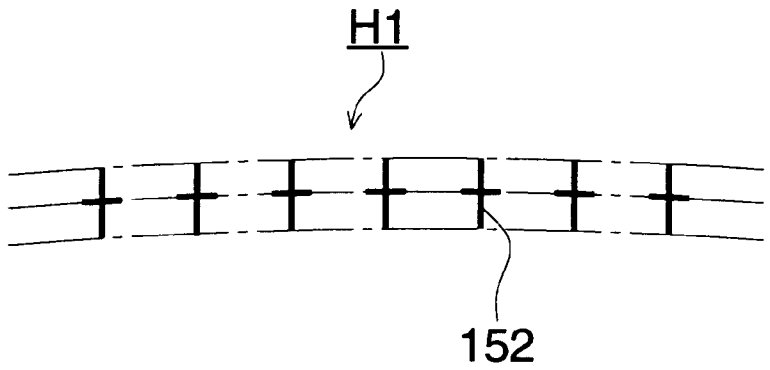
FIG. 7 is a diagram showing a shape of a combination of the spurred wheels shown in FIG. 6.

The first structure of the invention will be explained as follows, referring to FIGS. 6 and 7. FIG. 6 is a diagram showing the first example of a conveyance section, and FIG. 7 is a diagram showing the form of a group of spurred wheels shown in FIG. 6.

The recording sheet P on both sides of which color toner images are formed is separated from the toner image receiving body 14*a* through the curvature of driving roller 14*d* that drives the toner image receiving body 14*a* and through the neutralizing operation conducted by sheet separation AC neutralizing unit 14*h* representing a recording sheet separating means provided to face the toner image receiving body 14*a*. The recording sheet P separated from the toner image receiving body 14*a* is passed through conveyance section 150 having therein spurred wheels 152 which guide the reverse side of the recording sheet P, and then is conveyed to the fixing unit 17 which is a fixing means where the recording sheet is sandwiched in the nip portion formed between fixing roller 17*a* and pressure roller 17*b* and is given heat and pressure whereby toner images on both the obverse and reverse sides of the recording sheet P are fixed.

When a thick sheet of about 56–65 kg/m$^2$ is used as recording sheet P in this case, thick recording sheet P is slightly bent along the curvature of the end portion of the toner image receiving body 14*a* to be separated from the toner image receiving body 14*a*, and then, it is conveyed under the condition that it is slightly tilted downward, so that it advances almost straight to the nip portion of the fixing unit 17, as shown with one-dot chain lines in FIG. 6. On the other hand, under the ambient condition of the humidity which is as low as about 35%, the thick sheep P mentioned above tends to be difficult to bend along the curvature of the end portion of the toner image receiving body 14*a*. It is therefore more preferable that auxiliary spurred wheels 152 shown with dotted lines in FIG. 6 are provided over the obverse side (top side) of the recording sheet P so that the recording sheet P is advanced straight to the nip portion.

To the contrary, when a thin sheet of 55 kg/m$^2$ or less is used as recording sheet P, the thin recording sheet P is bent toward its reverse side along the curvature of the end portion of the toner image receiving body 14*a* and then is separated from the toner image receiving body 14*a* as shown with thick lines in FIG. 6, and is moved to conveyance section 150 under the condition that it is tilted downward and then is conveyed by the spurred wheels 152 provided on the conveyance section 150 in a way that the movement direction of the recording sheet P is bent to return to its obverse side. In this case, the recording sheet P enters the nip portion of the fixing unit 17 straight without waving, and then is pulled by the upper and lower rollers of the fixing unit 17 rotating at the speed which is the same as or slightly lower than the movement speed of the toner image receiving body 14*a*, whereby it is conveyed over the conveyance section 150 under the condition that the trailing edge of the recording sheet P mostly touches or leaves the spurred wheels 152 provided on the conveyance section 150.

When the recording sheet P conveyed by the toner image receiving body 14*a* is bent toward its reverse side along the curvature of the end portion of the toner image receiving body 14*a* and is separated from the toner image receiving body 14*a*, the radius of curvature of driving roller 14*d* which forms the curvature of the end portion of the toner image receiving body 14*a* is preferably 20 mm or less, and it is more preferably 10 mm or less. Due to the radius of curvature of 20 mm or less and to sheet separation AC neutralizing unit 14*h* representing a recording sheet separating means provided to face the end portion of the toner image receiving body 14*a* as in the present example, the recording sheet P is separated stably and is moved stably to the conveyance section 150 owing to the curvature of the toner image receiving body 14*a* and to neutralizing operation of the sheet separation AC neutralizing unit 14*h*. When the radius of curvature is made to be 10 mm or less, it is not necessary to provide the sheet separation AC neutralizing unit 14*h*, and recording sheet P can be separated stably from the toner image receiving body 14*a* owing only to the curvature of the end portion of the toner image receiving body 14*a*, and it can also be moved stably to the conveyance section 150.

When assuming that an angle formed by the movement direction of recording sheet P conveyed by the toner image receiving body 14*a* (line L1) and tangent line L2 at the position where the recording sheet P is separated from the toner image receiving body 14*a* (hereinafter referred to as separation point of recording sheet P) is $\alpha 1$, it is preferable for the recording sheet P to enter the nip portion formed between fixing roller 17*a* and pressure roller 17*b* of the fixing unit 17 that the angle $\alpha 1$ is 20°±15°. When assuming that an angle formed between the tangent line L2 at the separation point of recording sheet P and the direction (line L3) in which the recording sheet P enters the fixing unit 17 from the conveyance section 150 is $\beta 1$, the angle $\beta 1$ of 30°±20° is preferable.

Further, it is preferable that an absolute value of a difference between the above-mentioned angle $\alpha 1$ and the angle $\beta 1$ is not more than 20°, and it is especially preferable that $\alpha 1$ is nearly equal to $\beta 1$ and whereby the toner image receiving body 14*a* and the nip portion formed between the upper roller and the lower roller of the fixing unit 17 are mostly on the same straight line (not shown).

Due to the foregoing, the recording sheet P which is separated from the toner image receiving body 14*a* and has on its both sides toner images can be conveyed stably from the toner image receiving body 14*a* to the fixing unit 17, without having the toner images disturbed. In particular, even when a thin sheet is used as recording sheet P, the recording sheet P is conveyed through the conveyance section 150 with its reverse side supported by spurred wheels 152, and enters the fixing unit 17 under the condition that it is lifted toward its obverse side (upward). Therefore, the recording sheet P can be pinched in the fixing unit 17 without creasing.

In addition, it is preferable that spurred wheels 152 are arranged so that the central portion of group of spurred wheels H1 which is formed by a plurality of spurred wheels 152 arranged in the direction perpendicular to the conveyance direction for recording sheet P, namely in the longitudinal direction of the fixing unit 17 may be made to be convex toward the obverse side of the recording sheet P (upward) as shown in FIG. 7. When an arrangement is made so that the central portion of the group of spurred wheels H1 may be made to be convex upward, the recording sheet P is conveyed from the conveyance section 150 to the fixing unit 17 under the condition that the recording sheet P is stretched toward its both edges from its central portion. Therefore, the occurrence of creases of the recording sheet P can be prevented when it is pinched by the nip portion of the fixing unit 17.

Figure 8:
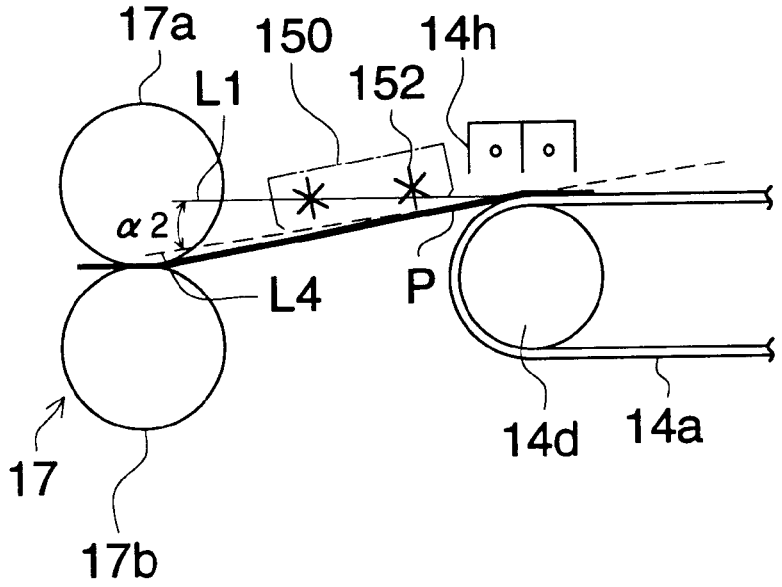
FIG. 8 is a diagram showing the second example of the conveyance section.
Figure 9:
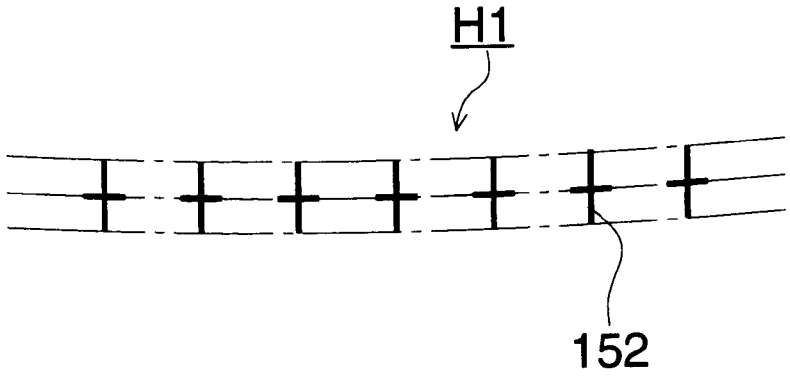
FIG. 9 is a diagram showing a shape of a combination of the spurred wheels shown in FIG. 8.

The second structure of the invention will be explained as follows, referring to FIGS. 8 and 9. FIG. 8 is a diagram showing the second example of a conveyance section, and FIG. 9 is a diagram showing a form of a group of spurred wheels shown in FIG. 8.

Due to the curvature of driving roller 14*d* that drives toner image receiving body 14*a* and to a neutralizing operation conducted by sheet separation AC neutralizing unit 14*h* which is provided to face the driving roller 14*d* as a recording sheet separating means, recording sheet P on both sides of which color toner images are formed is separated from the toner image receiving body 14*a*. The recording sheet P separated from the toner image receiving body 14*a* is passed through conveyance section 150 having spurred wheels 152 which guide the obverse side of the recording sheet P, and then is conveyed to fixing unit 17 representing a fixing means where the recording sheet P is pinched by the nip portion formed by fixing roller 17*a* and pressure roller 17*b* to be given heat and pressure, thus, toner images sticking to both obverse side and the reverse side of the recording sheet P are fixed.

In this case, when a thick sheet of 65 kg/m$^2$ or more or a thick paper of 65 kg/m$^2$ or less and yet has a high stiffness is used as recording sheet P, the thick recording sheet P is separated from the toner image receiving body 14*a* while being slightly bent or hardly bent along the curvature of the end portion of the toner image receiving body 14*a* as shown with thick lines in FIG. 8, then is moved to the conveyance section 150 under the condition that the recording sheet is slightly tilted downward or it advances straight, and then is conveyed to the fixing unit 17 with the movement direction of the recording sheet P being deflected toward its reverse side by spurred wheels 152 provided on the conveyance section 150. In this case, the recording sheet P enters the nip portion of the fixing unit 17, while keeping its straight form without waving.

When recording sheet P conveyed by toner image receiving body 14*a* is separated from the toner image receiving body 14*a* while the recording sheet is bent toward its reverse side along the curvature of the end portion of the toner image receiving body 14*a*, it is preferable that the radius of curvature of driving roller 14*d* constituting the curvature of the end portion of the toner image receiving body 14*a* is not more than 20 mm, and it is more preferable that the radius of curvature is not more than 10 mm. When the radius of curvature is made to be 20 mm or less and sheet separation AC neutralizing unit 14*h* representing a recording sheet separating means is provided to face the end portion of the toner image receiving body 14*a* as in the present example, the recording sheet P is separated stably due to the curvature of the toner image receiving body 14*a* and to a neutralizing operation conducted by the sheet separation AC neutralizing unit 14*h*. When the radius of curvature is made to be 10 mm or less, it is not necessary to provide the sheet separation AC neutralizing unit 14*h*, and separation of the recording sheet P from the toner image receiving body 14*a* can be carried out stably due to the curvature of the end portion of the toner image receiving body 14*a* alone.

When assuming that $\alpha 2$ represents an angle formed between the movement direction (line L1) of recording sheet P conveyed by toner image receiving body 14*a* and the direction (line L4) in which the recording sheet P whose movement direction has been deflected by spurred wheels 152 guiding the obverse side of the recording sheet P enters fixing unit 17 from conveyance section 150, $\alpha 2$ which is 20°±15° is preferable for the recording sheet P to enter a nip portion formed between fixing roller 17*a* and pressure roller 17*b*. Due to this, even when a thick sheet that is highly stiff is used as recording sheet P, the recording sheet P is conveyed while its obverse side is being supported by spurred wheels 152 through conveyance section 150, and thereby is advanced to fixing unit 17 while the recording sheet P is being pressed to its reverse side (downward) to be bent. Therefore, the recording sheet P is stably conveyed, without having toner images thereon disturbed, from the toner image receiving body 14*a* to the fixing unit 17, and is pinched in the fixing unit 17 without creasing.

Further, it is preferable to arrange spurred wheels 152 so that the central portion of group of spurred wheels H1 formed by a plurality of spurred wheels 152 arranged in the direction perpendicular to the conveyance direction for recording sheet P, namely in the longitudinal direction of fixing unit 17 may be made to be convex toward the reverse side of the recording sheet P (downward) as shown in FIG. 9. By making an arrangement so that the central portion of the group H1 of spurred wheels 152 may be made to be convex downward, the recording sheet P is conveyed from the conveyance section 150 to the fixing unit 17 under the condition that the recording sheet P is stretched toward its both edges from its central portion. Therefore, the occurrence of creases of the recording sheet P can be prevented when it is pinched by the nip portion of the fixing unit 17.

The third structure of the invention will be explained as follows.

In the third structure of the invention, there is provided a conveyance section having therein spurred wheels which guide the reverse side of recording sheet P explained in FIG. 6 and spurred wheels which guide the obverse side of the recording sheet P explained in FIG. 8. In the case of thin recording sheet P which is bent toward its reverse side along the curvature of the end portion of toner image receiving body 14*a* and then is separated from the toner image receiving body 14*a* as shown with thick lines in FIG. 6, the recording sheet P is conveyed to fixing unit 17 after the movement direction of the recording sheet P is deflected by spurred wheels guiding the reverse side of the recording sheet P toward the obverse side of the recording sheet P. In the case of thick recording sheet P which is slightly bent or is hardly bent along the curvature of the end portion of toner image receiving body 14*a* and then is separated from the toner image receiving body 14*a* as shown with thick lines in FIG. 8, the recording sheet P is conveyed to fixing unit 17 after the movement direction of the recording sheet P is further deflected toward the reverse side of the recording sheet P by spurred wheels guiding the obverse side of the recording sheet P. When providing the spurred wheels for guiding the reverse side of the recording sheet P and those for guiding the obverse side of the recording sheet P, the recording sheet P is stably conveyed, without having toner images thereon disturbed, from the toner image receiving body 14*a* to the fixing unit 17, and is pinched in the fixing unit 17 without creasing, even when separation of the recording sheet from the toner image receiving body 14*a* varies depending on the type and thickness of the recording sheet P.

Figure 10:
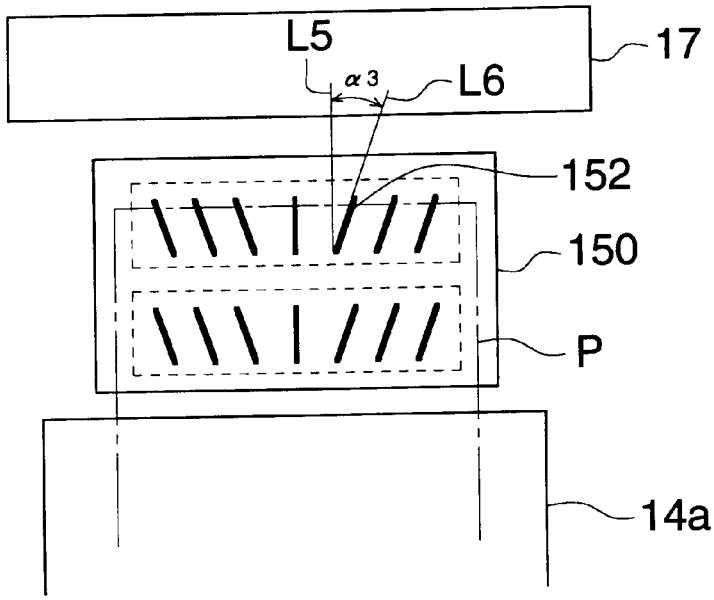
FIG. 10 is a diagram showing the third example of the conveyance section.

The fourth structure of the invention will be explained as follows, referring to FIG. 10. FIG. 10 is a diagram showing the third example of the conveyance section.

Due to the curvature of driving roller 14*d* that drives toner image receiving body 14*a* and to a neutralizing operation conducted by sheet separation AC neutralizing unit 14*h* which is provided to face the driving roller 14*d* as a recording sheet separating means, recording sheet P on both sides of which color toner images are formed is separated from the toner image receiving body 14*a*. The recording sheet P separated from the toner image receiving body 14*a* is passed through conveyance section 150 having spurred wheels 152 which guide the recording sheet P, and then is conveyed to fixing unit 17 representing a fixing means where the recording sheet P is pinched by the nip portion formed by fixing roller 17*a* and pressure roller 17*b* to be given heat and pressure, thus, toner images sticking to both obverse side and the reverse side of the recording sheet P are fixed.

As the conveyance section 150, there are used conveyance section 150 having therein spurred wheels 152 which guide the reverse side of recording sheet P explained in FIG. 6, conveyance section 150 having therein spurred wheels 152 which guide the obverse side of recording sheet P explained in FIG. 8, and a conveyance section having therein spurred wheels guiding the obverse side of recording sheet P and spurred wheels guiding the reverse side of recording sheet P stated above.

In the invention, groups of spurred wheels H1 and H2 each being formed by plural spurred wheels are arranged to be in a herringbone shape opened in the conveyance direction for recording sheet P, namely, each spurred wheel 152 of the groups of spurred wheels H1 and H2 is arranged to be in a herringbone shape for the central spurred wheel 152 as shown in FIG. 10. By arranging each spurred wheel 152 of the groups of spurred wheels H1 and H2 to be in a herringbone shape opened in the conveyance direction of recording sheet P, the recording sheet P is conveyed from conveyance section 150 to fixing unit 17 while the recording sheet P is being stretched from its central portion to its both edges. Therefore, the occurrence of creases of the recording sheet P can be prevented when it is pinched by the nip portion of the fixing unit 17.

When assuming that $\alpha 3$ represents an angle formed by the conveyance direction for recording sheet P (line L5) and the spurred wheel 152 arranged to be in a herringbone shape shown by line L6, angle $\alpha 3$ which is in a range from 5° to 20° is preferable. When the angle $\alpha 3$ is less than 5°, creases of the recording sheet P can not be smoothed sufficiently, and when the angle $\alpha 3$ exceeds 20°, the recording sheet P is sometimes caught by spurred wheels 152.

When the reverse side of recording sheet P is guided, it is preferable to arrange spurred wheels 152 so that the central portion of the group of spurred wheels H1 may be made to be convex toward the obverse side of the recording sheet P (upward) as shown in FIG. 7 mentioned above, and when the obverse side of recording sheet P is guided, it is preferable to arrange spurred wheels 152 so that the central portion of the group of spurred wheels H1 may be made to be convex toward the reverse side of the recording sheet P (downward) as shown in FIG. 9 mentioned above.

Figure 11:
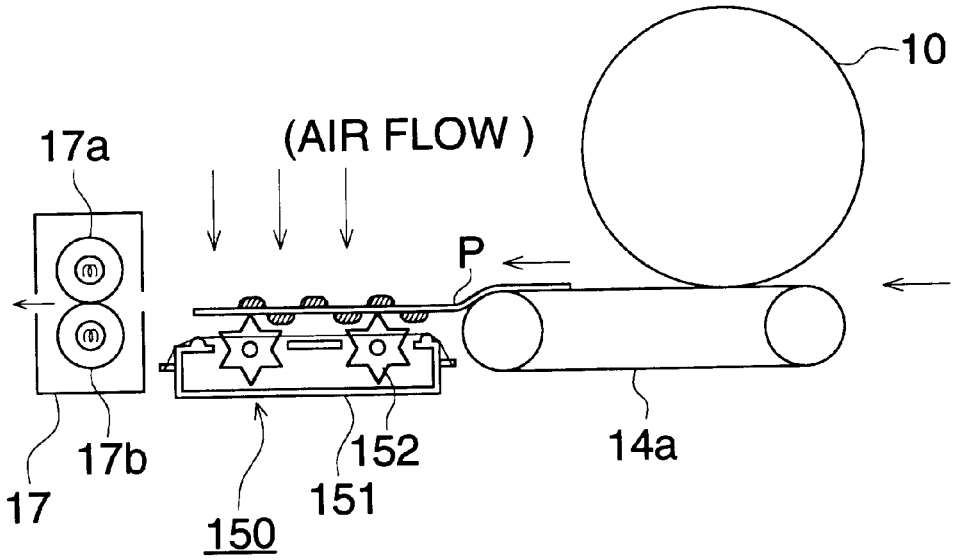
FIG. 11 is a diagram showing the fourth example of the conveyance section.
Figure 12:
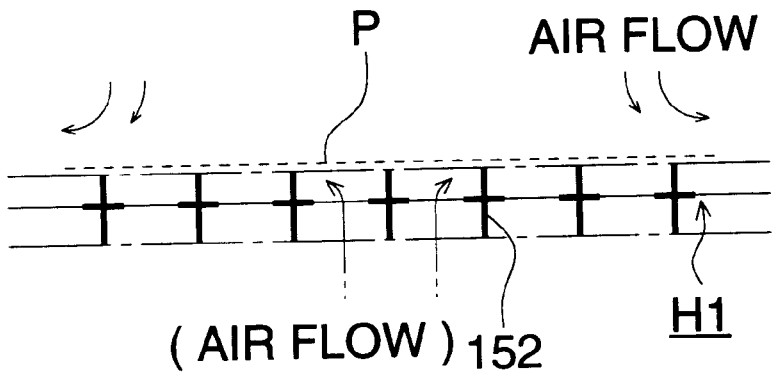
FIG. 12 is a diagram showing the first example of a combination of the spurred wheels shown in FIG. 11.

The fifth structure of the invention will be explained as follows, referring to FIGS. 11–13. FIG. 11 is a diagram showing the fourth example of the conveyance section, FIG. 12 is a diagram showing the first example of a group of spurred wheels shown in FIG. 11, while FIG. 13 is a diagram showing the second example of a group of spurred wheels shown in FIG. 11.

Recording sheet P on both sides of which color toner images are formed is separated from toner image receiving body 14*a*, and the separated recording sheet P is passed through conveyance section 150 having therein spurred wheels 152, and then is conveyed to fixing unit 17. When the recording sheet P moves through the conveyance section 150 while spurred wheels 152 are guiding the reverse side or the obverse side (reverse side in the present example) of the recording sheet P, an air flow is jetted on the recording sheet from its side which is not guided by the spurred wheels 152 (the obverse side of recording sheet P, namely upper part, in the present example) by an unillustrated fan or the like. Due to this, the recording sheet P separated from toner image receiving body 14*a* is conveyed stably to fixing unit 17 by the conveyance section 150 having therein spurred wheels 152.

It is preferable that both edge portions of the recording sheet P conveyed through the conveyance section 150 are jetted by the air flow. Due to this, the recording sheet P is stretched to both sides in its lateral direction against the conveyance direction for the recording sheet P, thus the occurrence of unevenness and creases on the recording sheet P during the conveyance therefor can be prevented. In addition to this, it is also possible to convey the recording sheet P under the condition that a jet of air is further directed to the central portion of the recording sheet P by an unillustrated fan or the like from the side (reverse side, namely downward, in the present example) of the recording sheet P guided by spurred wheels 152, and in this case, the recording sheet P is further pulled in the lateral direction perpendicular to the conveyance direction to be conveyed the fixing unit 17.

Figure 13:
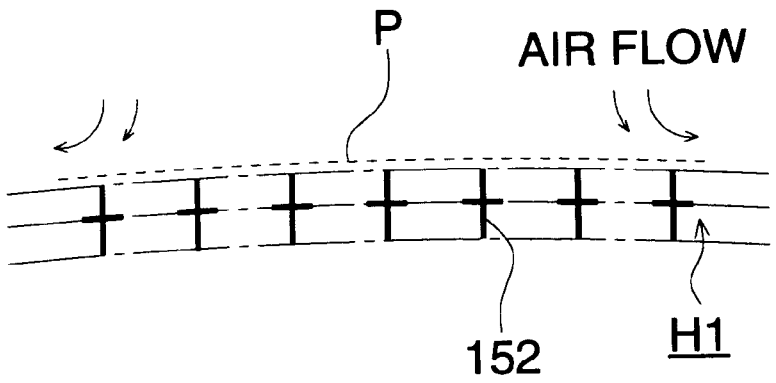
FIG. 13 is a diagram showing the second example of a combination of the spurred wheels shown in FIG. 11.

It is more preferable that spurred wheels 152 are arranged so that the central portion of group of spurred wheels H1 formed by plural spurred wheels 152 may be made to be convex toward the side of the recording sheet P which is not guided by spurred wheels 152 (obverse side of the recording sheet P, namely upward, in the present example) as shown in FIG. 13, and the recording sheet P is conveyed to the fixing unit 17 while the recording sheet P is being conveyed under the condition that it is pulled to its both sides in the lateral direction perpendicular to the conveyance direction and jets of air are being directed along both edges of the recording sheep P by an unillustrated fan or the like from the upper part of the conveyance section 150.

In the explanation of each structure of the invention, the group of spurred wheels H1 only has been explained. However, group of spurred wheels H2 can also be applied and it is included in the invention. Though two groups of spurred wheels have been illustrated, only one group or two or more groups can be used and they are included in the invention.

Owing to the invention, it is prevented that the second image carrying means is deformed by heat coming from a fixing unit, or toner images on the second image carrying means are slightly fused or fixed. In particular, even when a thin sheet or a thick sheet is used as a recording sheet, neither toner images on the recording sheet are disturbed nor creases on the recording sheet are generated, thus the recording sheet can be conveyed stably from the second image carrying means to a fixing means.

What is claimed is:

1. An image forming apparatus comprising:

(a) a first image carrying means for carrying a toner image formed by a toner image forming means;

(b) a second image carrying means for carrying the toner image transferred from the first image carrying means, and for conveying a recording sheet;

(c) a first transfer means for transferring the toner image carried on the first image carrying means onto the second image carrying means or an obverse side of the recording sheet;

(d) a second transfer means for transferring the toner image carried on the second image carrying means onto a reverse side of the recording sheet;

(e) a fixing means for fixing the toner image transferred on the recording sheet;

wherein the second image carrying means is provided with a curved portion at an end on a side of the fixing means, at which the recording sheet conveyed by the second image carrying means is bent toward the reverse side of the recording sheet, so as to separate the recording sheet from the second image carrying means; and (f) a conveyance section provided between the curved portion of the second image carrying means and the fixing means, for conveying the recording sheet separated from the second image carrying means to the fixing means, the conveyance section having a plurality of rotatable spurred wheels each equipped with a plurality of protrusions on a circumferential surface thereof, the plurality of rotatable spurred wheels being provided both in a moving direction of the recording sheet and in a direction perpendicular to the moving direction of the recording sheet, wherein the plurality of spurred wheels comes into contact with the obverse or reverse side of the recording sheet to convey the recording sheet so that the moving direction of the recording sheet is changed toward a side which is opposite to the side where the plurality of spurred wheels contact the recording sheet, wherein when the recording sheet enters the fixing means, an angle $\alpha 1$ between an extension line of the moving direction of the recording sheet conveyed by the second image carrying means and a tangential line at a separating point at which the recording sheet is separated from the second image carrying means, is $20° \pm 15°$, and wherein an angle $\beta 1$ between the tangential line at the separating point and an entering direction into the fixing means of the recording sheet, the moving direction of which has been bent by the spurred wheels is $30° \pm 20°$.

2. The image forming apparatus of claim 1, wherein the conveyance section is provided with the spurred wheels so that the spurred wheels guide the reverse side of the recording sheet, and thereby the moving direction of the recording sheet is bent toward the obverse side of the recording sheet.

3. The image forming apparatus of claim 1, wherein the following expression is satisfied, $|\alpha 1-\beta 1| \leqq 20°$.

4. The image forming apparatus of claim 1, wherein an air flow is applied to the recording sheet from a side which is opposite to the side where the spurred wheels contact the recording sheet to guide.

5. An image forming apparatus comprising:

(a) a first image carrying means for carrying a toner image formed by a toner image forming means;

(b) a second image carrying means for carrying the toner image transferred from the first image carrying means, and for conveying a recording sheet;

(c) a first transfer means for transferring the toner image carried on the first image carrying means onto the second image carrying means or an obverse side of the recording sheet;

(d) a second transfer means for transferring the toner image carried on the second image carrying means onto a reverse side of the recording sheet;

(e) a fixing means for fixing the toner image transferred on the recording sheet;

wherein the second image carrying means is provided with a curved portion at an end on a side of the fixing means, at which the recording sheet conveyed by the second image carrying means is bent toward the reverse side of the recording sheet, so as to separate the recording sheet from the second image carrying means; and (f) a conveyance section provided between the curved portion of the second image carrying means and the fixing means, for conveying the recording sheet separated from the second image carrying means to the fixing means, the conveyance section having a plurality of rotatable spurred wheels each equipped with a plurality of protrusions on a circumferential surface thereof, the plurality of rotatable spurred wheels being provided both in a moving direction of the recording sheet and in a direction perpendicular to the moving direction of the recording sheet, wherein the plurality of spurred wheels comes into contact with the obverse or reverse side of the recording sheet to convey the recording sheet so that the moving direction of the recording sheet is changed toward a side which is opposite to the side where the plurality of spurred wheels contact the recording sheet, wherein a set of said plurality of spurred wheels provided in a direction perpendicular to said moving direction of the recording sheet has a central portion made convex toward the obverse side.

6. An image forming apparatus comprising:

(a) a first image carrying means for carrying a toner image formed by a toner image forming means;

(b) a second image carrying means for carrying the toner image transferred from the first image carrying means, and for conveying a recording sheet;

(c) a first transfer means for transferring the toner image carried on the first image carrying means onto the second image carrying means or an obverse side of the recording sheet;

(d) a second transfer means for transferring the toner image carried on the second image carrying means onto a reverse side of the recording sheet;

(e) a fixing means for fixing the toner image transferred on the recording sheet;

wherein the second image carrying means is provided with a curved portion at an end on a side of the fixing means, at which the recording sheet conveyed by the second image carrying means is bent toward the reverse side of the recording sheet, so as to separate the recording sheet from the second image carrying means; and (f) a conveyance section provided between the curved portion of the second image carrying means and the fixing means, for conveying the recording sheet separated from the second image carrying means to the fixing means, the conveyance section having a plurality of rotatable spurred wheels each equipped with a plurality of protrusions on a circumferential surface thereof, the plurality of rotatable spurred wheels being provided both in a moving direction of the recording sheet and in a direction perpendicular to the moving direction of the recording sheet, wherein the plurality of spurred wheels comes into contact with the obverse or reverse side of the recording sheet to convey the recording sheet so that the moving direction of the recording sheet is changed toward a side which is opposite to the side where the plurality of spurred wheels contact the recording sheet, wherein a set of said plurality of spurred wheels provided in a direction perpendicular to a conveying direction of the recording sheet is obliquely arranged with respect to the moving direction so that a distance between a point on an extension line perpendicular to a rotation axis of each spurred wheel and a center line in the moving direction of the recording sheet increases as the point on the extension line approaches the fixing means, wherein an angle $\alpha 3$ between the moving direction of the recording sheet and said extension line is 5° to 20°.

7. An image forming apparatus comprising:

(a) a first image carrying means for carrying a toner image formed by a toner image forming means;

(b) a second image carrying means for carrying the toner image transferred from the first image carrying means, and for conveying a recording sheet;

(c) a first transfer means for transferring the toner image carried on the first image carrying means onto the second image carrying means or an obverse side of the recording sheet;

(d) a second transfer means for transferring the toner image carried on the second image carrying means onto a reverse side of the recording sheet;

(e) a fixing means for fixing the toner image transferred on the recording sheet;

wherein the second image carrying means is provided with a curved portion at an end on a side of the fixing means, at which the recording sheet conveyed by the second image carrying means is bent toward the reverse side of the recording sheet, so as to separate the recording sheet from the second image carrying means; and (f) a conveyance section provided between the curved portion of the second image carrying means and the fixing means, for conveying the recording sheet separated from the second image carrying means to the fixing means, the conveyance section having a plurality of rotatable spurred wheels each equipped with a plurality of protrusions on a circumferential surface thereof, the plurality of rotatable spurred wheels being provided both in a moving direction of the recording sheet and in a direction perpendicular to the moving direction of the recording sheet, wherein the plurality of spurred wheels comes into contact with the obverse or reverse side of the recording sheet to convey the recording sheet so that the moving direction of the recording sheet is changed toward a side which is opposite to the side where the plurality of spurred wheels contact the recording sheet, wherein an air flow is applied to the recording sheet from a side which is opposite to the side where the spurred wheels contact the recording sheet to guide.

8. The image forming apparatus of claim 7, wherein the air flow is applied toward both ends in a direction perpendicular to a moving direction of the recording sheet.

9. The image forming apparatus of claim 7, wherein a set of said plurality of spurred wheels provided in a direction perpendicular to the moving direction of the recording sheet has a central portion made convex toward a side which is opposite to the side where the spurred wheels contact the recording sheet to guide.

* * * * *